US006132248A

United States Patent [19]

Ramey

[11] Patent Number: 6,132,248

[45] Date of Patent: Oct. 17, 2000

[54] CONNECTOR HAVING A MEMORY MODULE LOCKING APPARATUS

[75] Inventor: Samuel C. Ramey, Louisville, Ky.

[73] Assignee: Robinson Nugent, Inc., New Albany, Ind.

[21] Appl. No.: 09/331,515

[22] PCT Filed: May 29, 1998

[86] PCT No.: PCT/US98/10990

§ 371 Date: Jun. 22, 1999

§ 102(e) Date: Jun. 22, 1999

[87] PCT Pub. No.: WO98/54794

PCT Pub. Date: Dec. 3, 1998

Related U.S. Application Data

[60] Provisional application No. 60/048,066, May 30, 1997, abandoned.

[51] Int. Cl.[7] ..... H01R 13/60

[52] U.S. Cl. ..... 439/570; 439/326

[58] Field of Search ..... 439/570, 571, 439/326, 328, 352

[56] References Cited

U.S. PATENT DOCUMENTS 5,622,519 4/1997 Bixler et al. ..... 439/570

5,676,555 10/1997 Yu et al. ..... 439/328

5,718,594 2/1998 Tondreault et al. ..... 439/326

5,730,614 3/1998 Yu ..... 439/326

*Primary Examiner*—Paula Bradley

*Assistant Examiner*—Briggitte R. Hammond

*Attorney, Agent, or Firm*—Barnes & Thornburg

[57] ABSTRACT

An electrical connector apparatus (10) includes an insulative housing (14) having an elongated slot (16) for receiving an end edge (18) of a module (12), a plurality of contacts (20) located in the slot (16) for engaging conductive pads (22) on the module (12), and at least one side arm (36). The apparatus also includes a locking apparatus (28, 80) coupled to the side arm (36). The locking apparatus (28, 80) includes a torsional member (40, 82) having a longitudinal axis (48, 94), and an ejector (38, 84) coupled to the torsional member (40, 82). The ejector (38, 84) has a head (42, 86) configured to engage a side edge (32, 34) of the memory module (12) to retain the memory module (12) in the connector (10) and an axle (46, 92) coupled to the ejector (38, 84). The locking apparatus (28, 80) also includes a clip (54, 102) coupled to the side arm (36) of the housing (14). The clip (54, 102) includes an aperture (60, 106) configured to be located over the axle (46, 92) of the ejector (38, 84) to cause the ejector (38, 84) to rotate about its longitudinal axis (48, 94) during insertion and removal of the memory module (12).

9 Claims, 3 Drawing Sheets

CONNECTOR HAVING A MEMORY MODULE LOCKING APPARATUS

CROSS-REFERENCES TO RELATED APPLICATIONS

This application is a U.S. national application of international application Ser. No. PCT/US98/10990 filed May 29, 1998, which claims priority to U.S. provisional application Ser. No. 60/048,066 filed May 30, 1997, abandoned.

BACKGROUND AND SUMMARY OF THE INVENTION

The present invention relates to an electrical connector for electrically interconnecting a memory module to a printed circuit board. More particularly, the present invention relates to an electrical connector having an improved memory module locking apparatus for holding the memory module in place on the connector.

The electrical connector of the present invention is configured to receive small outline Dual In-Line Memory Modules (DIMMS). These memory modules are specifically described in the JEDEC Standard MO-160. The connector of the present invention and the memory modules are particularly useful in applications requiring low profile components, such as in notebook and laptop computers. The small outline connectors allow users to expand memory by adding and/or replacing memory modules with relative ease. It is understood that the present invention may be for securing any type of memory module or daughtercard to an electrical connector.

The basic configuration of the housing body of electrical connectors for receiving memory modules is also set by limitations of the JEDEC Standard and the industry requirement for second sources. However, various methods have been developed to lock the memory modules in place, hold the memory modules down, and eject the memory modules. The memory modules are typically inserted into the connector housing at an angle and then rotated until they lock into place. One known method of locking memory is the use of separate latches coupled to the connector. The memory modules are locked into place using latches which engage side edges of the printed circuit board of the module. The modules are ejected by unlocking the latches to allow the printed circuit board of the module to pop up due to the torque supplied to the module by a plurality of contacts located in the connector body.

According to one aspect of the present invention, a connector apparatus is provided for electrically coupling a module having an end edge including a plurality of conductive pads to a plurality of conductive traces on a printed circuit board. The apparatus includes an insulative housing formed to include an elongated slot for receiving the end edge of the module, a plurality of contacts located in the slot for engaging the conductive pads on the module, and at least one side arm. The apparatus also includes a locking apparatus coupled to the side arm. The locking apparatus includes a torsional member having a longitudinal axis, and an ejector coupled to the torsional member. The ejector has a head configured to engage a side edge of the memory module to retain the memory module in the connector and an axle coupled to the ejector. The locking apparatus also includes a clip coupled to the side arm of the housing. The clip includes an aperture configured to be located over the axle of the ejector to cause the ejector to rotate about its longitudinal axis during insertion and removal of the memory module.

In the illustrated embodiment, the clip includes a generally U-shaped spring section having first and second arms, and a head section coupled to the second arm. The head section of the clip is located adjacent the head of the ejector to stabilize the ejector. The clip is illustratively formed from a metal material and includes a retention section configured to engage the side arm of the housing to secure the clip to the housing.

The head of the ejector includes a ramp surface configured to engage the module to automatically rotate the ejector relative to the housing during installation of the module. The head of the ejector also includes a bottom surface configured to engage the module to secure the module to the housing.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
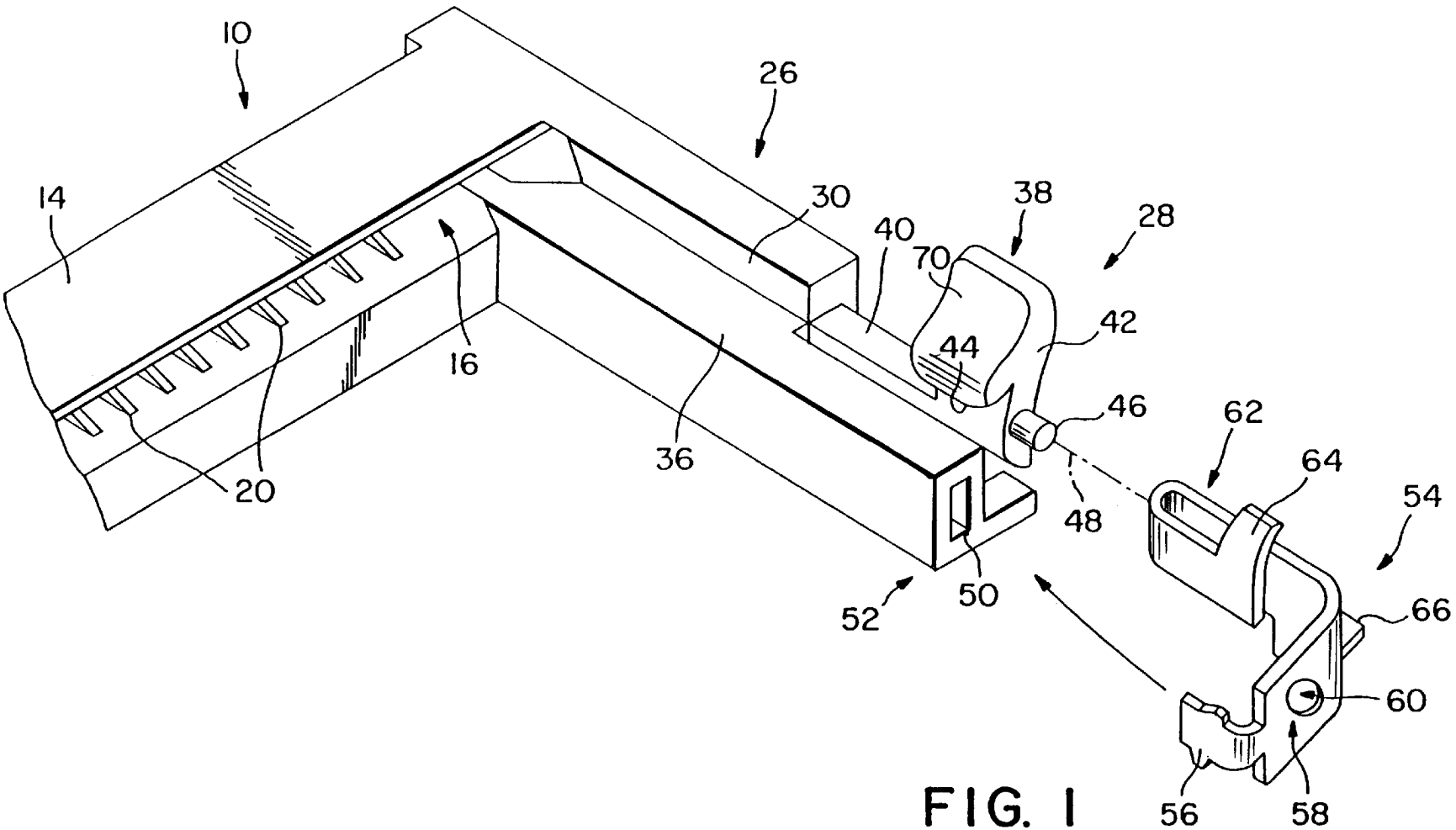
FIG. 1 is a perspective view of an electrical connector including a memory module locking apparatus of the present invention.
Figure 2:
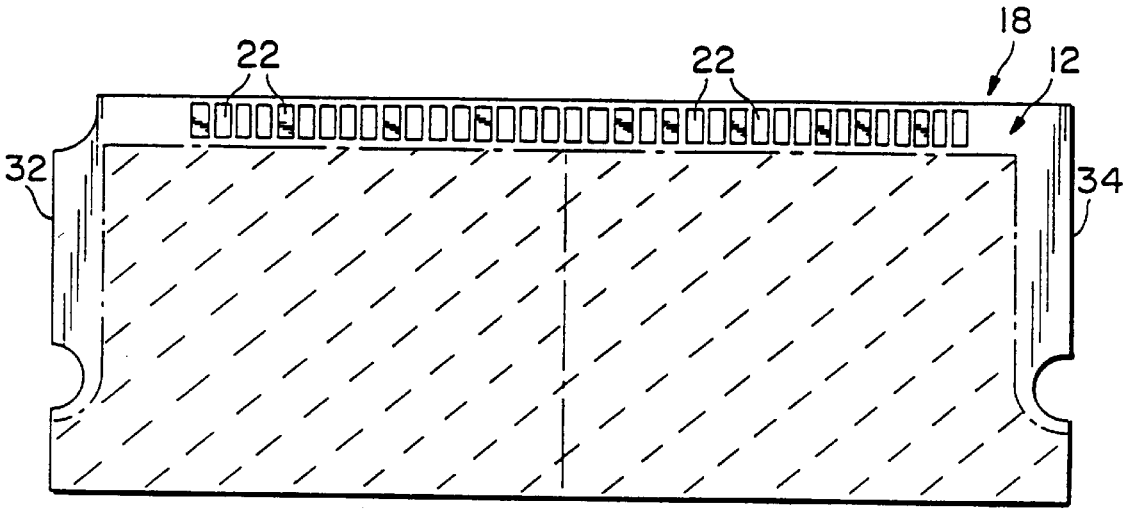
FIG. 2 is a side elevational view of a memory module card configured to be inserted into the electrical connector of FIG. 1.

Referring now to the drawings, FIG. 1 illustrates a first embodiment of an electrical connector 10 for coupling a memory module 12 illustrated in FIG. 2 to a printed circuit board 68. The connector 10 includes an insulative plastic housing 14 having an elongated slot 16 for receiving an end edge 18 of memory module 12 therein. Connector 10 includes a plurality of contacts 20 configured to engage conductive pads 22 formed on both sides of memory module 12 adjacent end edge 18 to couple the memory module 12 to the printed circuit board 68 electrically. Although a memory module 12 is disclosed, it is understood that the locking apparatus of the present invention may be used with any type module, daughtercard, or printed circuit board.

The connector 10 includes first and second side arms 26, only one of which is shown in FIG. 1. Both the first and second side arms 26 are formed to include a locking apparatus 28 configured to engage opposite side edges 32 and 34, respectively, of memory module 12 to hold memory module 12 in a locked position in connector 10. All components on the opposite side arm (not shown) are mirror images of the illustrated components, so only one side will be described.

Side arm 26 is formed to include a ledge 30 defining a surface 36 for engaging a side edge 32 or 34 of memory module 12. Locking apparatus 28 includes an ejector 38 integrally formed with side arm 26. Ejector 38 includes a torsional member 40 and an ejector head 42 formed integrally with torsional member 40. Ejector head 38 includes a bottom surface 44 for engaging side edge 32 or 34 of module 12 when the module 12 is installed into the connector 10. Ejector 38 is formed to include an axle 46 extending along a longitudinal axis 48. Side arm 26 is also formed to include an aperture 50 adjacent distal end 52.

Figure 3:
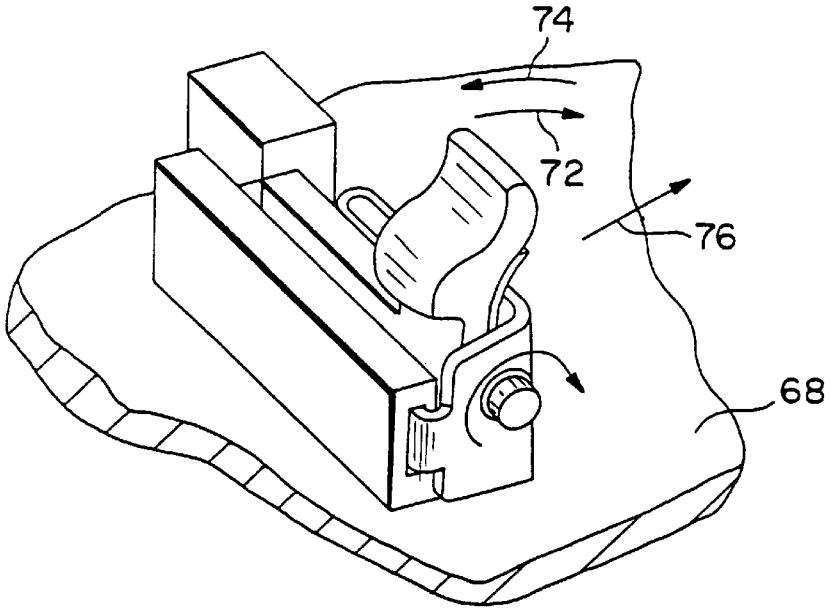
FIG. 3 is a perspective view illustrating a metal clip installed into a side arm of the connector adjacent an ejector of the locking apparatus.

A spring clip 54 is configured to be coupled to distal end 52 of each side arm 26. Spring clip 54 is illustratively formed from a stamped piece of flat sheet metal. Clip 54 is formed to include a barbed portion 56 configured to enter aperture 50 in side arm 26 to retain metal clip 54 in the side arm 26. Metal clip 54 includes a body portion 58 formed to include an aperture 60 aligned with axle 46 of ejector 38. Body portion 58 further includes a U-shaped spring arm 62 having a head 64 aligned behind head 42 of ejector 38. Metal clip 54 further includes a surface mount tail 66 configured to be mounted to the main printed circuit board 68 to provide further stability for metal clip 54. The clip 54 is illustrated in the installed position in FIG. 3.

In operation, memory module 12 is inserted into slot 16 of connector 10 and rotated downwardly toward a locked position. Opposite sides 32 and 34 of memory module 12 engage ramped surfaces 70 of ejector heads 42 on opposite side arm 26 to cause ejector heads 42 to rotate outwardly in the direction of arrow 72 of FIG. 3 until memory module 12 is located adjacent surface 36 of side arm 26. Once opposite ends 32 and 34 of memory module 12 move past heads 42, and below a bottom surface 44 of ejectors 38, ejectors 38 automatically rotate the direction of arrow 74 so that bottom surface 44 moves over the side edge 32 or 34 of module 12 to lock the memory module 12 to the connector 10.

When it is desired to release memory module 12 from connector 10, an operator applies an outwardly directed force to ejectors 38 in the direction of arrow 76. Since axles 46 of ejectors 38 are located within aperture 60 of spring clip 54, ejectors 38 do not move outwardly relative to surface 36. Instead, ejectors 38 rotate about axis 48 as illustrated by arrow 76 until the module 12 is released. Module 12 then automatically pivots upwardly due to a biasing force applied by contacts 20. Head 64 on metal clip 54 prevents over rotating of ejector 38. Torsional member 40 is a length sufficient and made of resilient material to permit limited rotation of the ejector 38 to release the module 12 without breaking.

In an alternative embodiment, ejector 48 may be formed from a separate insulative piece having a first axle rotatably coupled to spring arm 26. In this embodiment, axle 46 is still located within aperture 60 of metal clip 54. Head 64 of clip 54 biases head 42 of ejector 38 to its upright position.

Figure 4:
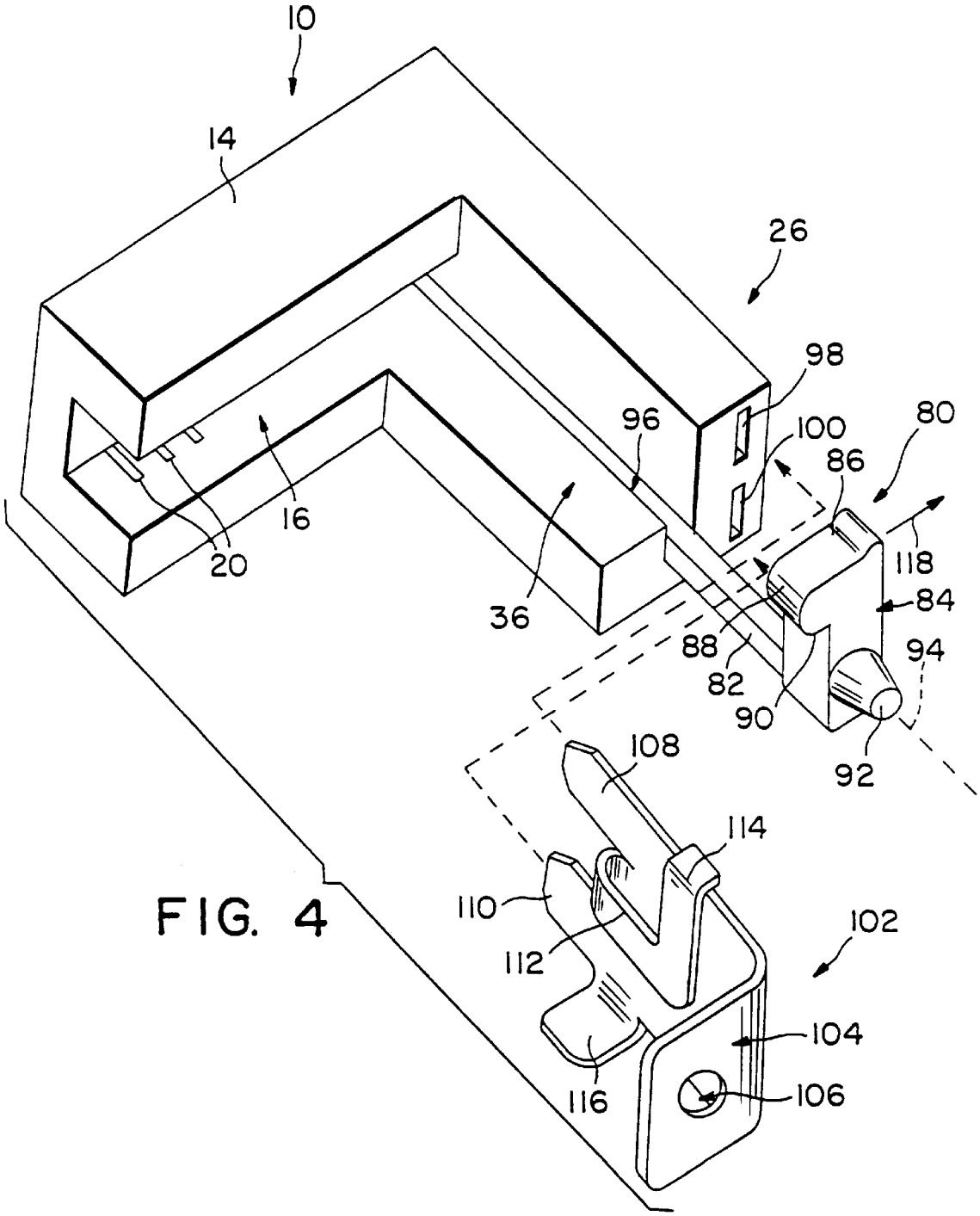
FIG. 4 is a perspective view of another embodiment of the present invention.

Another embodiment of the present invention is illustrated in FIG. 4. Those elements referenced by reference numbers the same as FIGS. 1–3 performed the same or similar function. In the FIG. 4 embodiment, locking apparatus 80 includes a torsional member 82 and ejector 84 formed integrally with torsional member 82. Ejector 84 includes a head 86 having a ramp surface 88 and a bottom locking surface 90. Ejector 84 includes an axle 92 defining an axis of rotation 94. Torsional member may be either formed integrally with side arm 26 or inserted into a slot 96 sized to receive the torsional member 82.

Side arm 26 is formed to include a pair of spaced apart apertures 98 and 100. A metal clip 102 includes a body portion 104 formed to include an aperture 106 for receiving axle 92. Clip 102 further includes two retention arms 108 and 110 sized to be inserted into apertures 98 and 100, respectively, to couple clip 102 to side arm 26. Clip 102 further includes a spring arm 112 having a head portion 114 configured to be situated behind ejector 84 to bias the ejector 84 toward its locked position and to prevent over rotation of ejector 84 during removal of a memory module 12. Clip 102 further includes a surface mount solder tail 116.

In operation, the FIG. 4 embodiment works as described above. Another side arm of the connector 10 includes a locking apparatus 80 which is mirror image of the illustrated locking apparatus. The memory module 12 is inserted into slot 16 and rotated downwardly until bottom surfaces 90 of locking members hold the memory module 12 against surface 36. To remove the memory module, an outwardly directed force is applied to ejector 84 in the direction of arrow 118. The outwardly directed force causes rotation of ejector 84 about axis 94 since axle 92 is captured by aperture 106 of clip 102. Once the module 12 is released, the module 12 springs upwardly due to the force of contacts 20 in connector 10 which engage the module.

Although the invention has been described in detail with reference to a certain preferred embodiment, variations and modifications exist within the scope and spirit of the present invention as described and defined in the following claims.

What is claimed is:

1. A connector apparatus for electrically coupling a module having an end edge including a plurality of conductive pads to a plurality of conductive traces on a printed circuit board, the apparatus comprising:

an insulative housing formed to include an elongated slot for receiving the end edge of the module, a plurality of contacts located in the slot for engaging the conductive pads on the module, and at least one side arm;

a locking apparatus coupled to the side arm, the locking apparatus including a torsional member having a longitudinal axis, an ejector coupled to the torsional member, the ejector having a head configured to engage a side edge of the memory module to retain the memory module in the connector and an axle coupled to the ejector, the locking apparatus also including a clip coupled to the side arm of the housing, the clip including an aperture configured to be located over the axle of the ejector to cause the ejector to rotate about its longitudinal axis during insertion and removal of the memory module.

2. The apparatus of claim 1, wherein the clip includes a generally U-shaped spring section having first and second arms, and a head section coupled to the second arm, the head section of the clip being located adjacent the head of the ejector to stabilize the ejector.

3. The apparatus of claim 1, wherein the clip is formed from a metal material.

4. The apparatus of claim 3, wherein the clip includes a retention section configured to engage the side arm of the housing to secure the clip to the housing.

5. The apparatus of claim 1, wherein the head of the ejector includes a ramp surface configured to engage the module to automatically rotate the ejector relative to the housing during installation of the module.

6. The apparatus of claim 5, wherein the head of the ejector includes a bottom surface configured to engage the module to secure the module to the housing.

7. The apparatus of claim 1, wherein the torsional member is integrally formed with the side arm, the ejector, and the axle.

8. The apparatus of claim 1, wherein the clip is formed from a metal material, the clip including a tail configured to be soldered to the printed circuit board.

9. The apparatus of claim 8, wherein the tail is a surface mount tail.

* * * * *